US011850468B2

(12) United States Patent
Al-Oboudi

(10) Patent No.: US 11,850,468 B2
(45) Date of Patent: Dec. 26, 2023

(54) ANKLE EXERCISER DEVICE

(71) Applicant: Waleed Al-Oboudi, San Diego, CA (US)

(72) Inventor: Waleed Al-Oboudi, San Diego, CA (US)

( * ) Notice: Subject to any disclaimer, the term of this patent is extended or adjusted under 35 U.S.C. 154(b) by 21 days.

(21) Appl. No.: 17/660,881

(22) Filed: Apr. 27, 2022

(65) Prior Publication Data

US 2022/0347521 A1 Nov. 3, 2022

Related U.S. Application Data

(60) Provisional application No. 63/201,464, filed on Apr. 30, 2021.

(51) Int. Cl.

| | |
|---|---|
| ***A63B 23/08*** | (2006.01) |
| ***A63B 23/035*** | (2006.01) |
| ***A63B 21/04*** | (2006.01) |
| ***A63B 21/055*** | (2006.01) |
| ***A63B 21/06*** | (2006.01) |
| ***A63F 7/04*** | (2006.01) |
| ***A63B 21/00*** | (2006.01) |

(52) U.S. Cl.

CPC ..... *A63B 23/08* (2013.01); *A63B 21/4015* (2015.10); *A63B 21/4034* (2015.10); *A63B 21/4047* (2015.10); *A63B 23/03508* (2013.01); *A63F 7/041* (2013.01); *A63B 21/0407* (2013.01); *A63B 21/0442* (2013.01); *A63B 21/0552* (2013.01); *A63B 21/06* (2013.01)

(58) Field of Classification Search

CPC ..... A63B 21/4015; A63B 21/4034; A63B 21/4047; A63B 21/04; A63B 21/0407; A63B 21/0442; A63B 21/055; A63B 21/0552; A63B 21/06; A63B 21/4049; A63B 23/03508; A63B 23/08; A63F 7/041; A63F 7/0688; A63F 9/0001; A63F 2009/0007

See application file for complete search history.

(56) References Cited

U.S. PATENT DOCUMENTS

| | | | | |
|---|---|---|---|---|
| 3,811,676 A * | 5/1974 | Greenberg | A63F 7/041 | 273/110 |
| 4,258,918 A * | 3/1981 | Nishimiya | A63F 7/041 | 273/110 |
| 7,011,308 B2 * | 3/2006 | Race | A63F 7/041 | 273/110 |
| 7,322,914 B1 * | 1/2008 | Vittone | A63B 23/025 | 482/146 |
| 7,367,565 B2 * | 5/2008 | Chiu | A63B 26/003 | 273/109 |

* cited by examiner

*Primary Examiner* — Megan Anderson
(74) *Attorney, Agent, or Firm* — Knobbe Martens Olson & Bear LLP

(57) ABSTRACT

An ankle exerciser device is described. The device can include a base component, a jointed foot plate assembly attached to the base component, the jointed foot plate assembly comprising a foot plate and a joint, the joint configured to allow the foot plate to tilt, pivot, and/or rotate relative to the base component, and a maze board attached to the foot plate of the jointed foot plate assembly, the maze board comprising a maze. A method of exercising the ankle can include positioning a ball in the maze of the maze board, and moving the ball through the maze by applying forces to the foot plate with a foot.

7 Claims, 7 Drawing Sheets

ANKLE EXERCISER DEVICE

PRIORITY APPLICATION(S)

This application claims priority to U.S. Provisional Application No. 63/201,464, filed Apr. 30, 2021, which is incorporated herein by reference. Any and all applications for which a foreign or domestic priority claim is identified in the Application Data Sheet as filed with the present application are hereby incorporated by reference under 37 CFR 1.57.

BACKGROUND

Field

This application relates generally to therapeutic devices for the ankle, and in particular, to an ankle exerciser device configured to help a user strengthen and exercise his or her ankle through the use of a game.

Description

Ankle and foot mobility is important for posture and movement. Restricted ankle or foot mobility can cause a host of problems that can affect the entire body. Modern living, which frequently involves sitting for long periods of times, can lead to tight calf muscles and/or other problems that limit ankle and foot mobility. Accordingly, there is a need for a device that can be used as a therapy aid to help users recover or improve ankle and foot mobility.

SUMMARY

The ankle exerciser systems, methods and devices described herein have innovative aspects, no single one of which is indispensable or solely responsible for their desirable attributes. Without limiting the scope of the claims, some of the advantageous features will now be summarized.

In a first aspect, an ankle exerciser device can include: a base component; a jointed foot plate assembly attached to the base component, the jointed foot plate assembly comprising a foot plate and a joint, the joint configured to allow the foot plate to tilt, pivot, and/or rotate relative to the base component; and a maze board attached to the foot plate of the jointed foot plate assembly, the maze board comprising a maze.

The device may include one or more of the following features: a ball positioned within the maze of the maze board; wherein a user can move the ball through the maze by tiling the maze board via the foot plate; wherein the base comprises a post, and the jointed foot plate assembly comprises a sleeve, and wherein the post is received within the sleeve to connect the jointed foot plate assembly to the base component; wherein the joint comprises a ball and socket joint; and/or wherein a ball of the ball and socket joint is attached to an end of the sleeve and a socket of the ball and socket joint is attached an underside of the foot plate.

In another aspect, a method for exercising the ankle can include: providing the device described herein; positioning a ball in the maze of the maze board; and moving the ball through the maze by applying forces to the foot plate with a foot.

BRIEF DESCRIPTION OF THE DRAWINGS

The above-mentioned aspects of the ankle exerciser systems, methods, and devices described herein, as well as other features, aspects, and advantages of the present technology will now be described in connection with various embodiments, with reference to the accompanying drawings. The illustrated embodiments, however, are merely examples and are not intended to be limiting. Like reference numbers and designations in the various drawings indicate like elements.

DETAILED DESCRIPTION

This application is directed to ankle exerciser devices, systems, and methods.

In the following detailed description, reference is made to the accompanying drawings, which form a part of the present disclosure. These illustrative embodiments are not meant to be limiting. Other embodiments may be utilized, and other changes may be made, without departing from the spirit or scope of the subject matter presented here. It will be readily understood that the aspects of the present disclosure, as generally described herein, and illustrated in the figures, can be arranged, substituted, combined, and designed in a wide variety of different configurations, all of which are explicitly contemplated and form part of this disclosure.

Figure 1A:
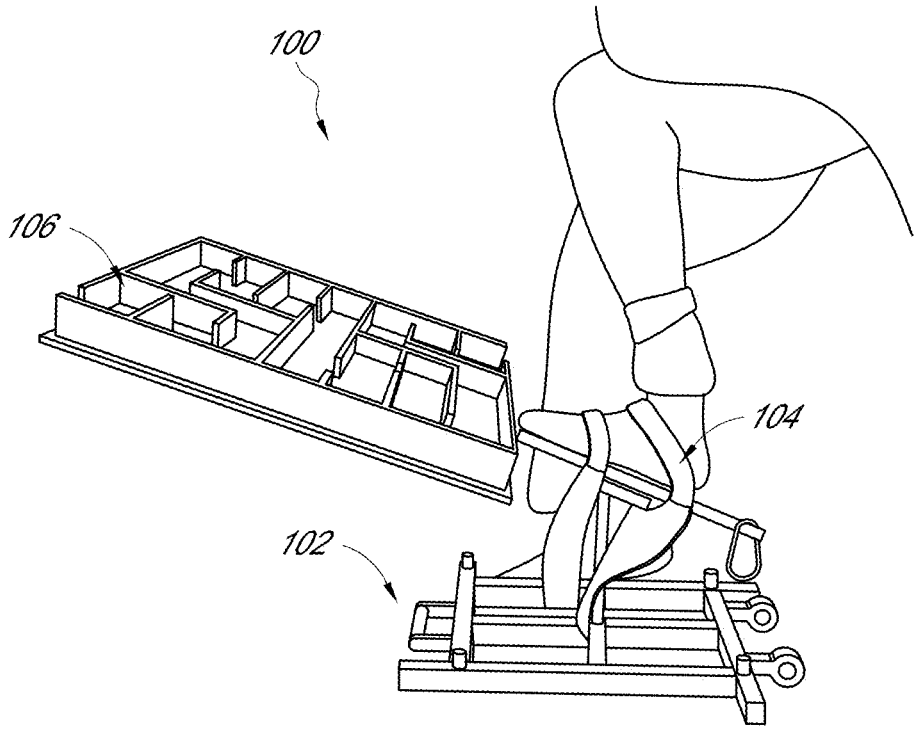
FIG. 1A illustrates a side perspective view of an embodiment of an ankle exerciser device during use by a user.
Figure 1B:
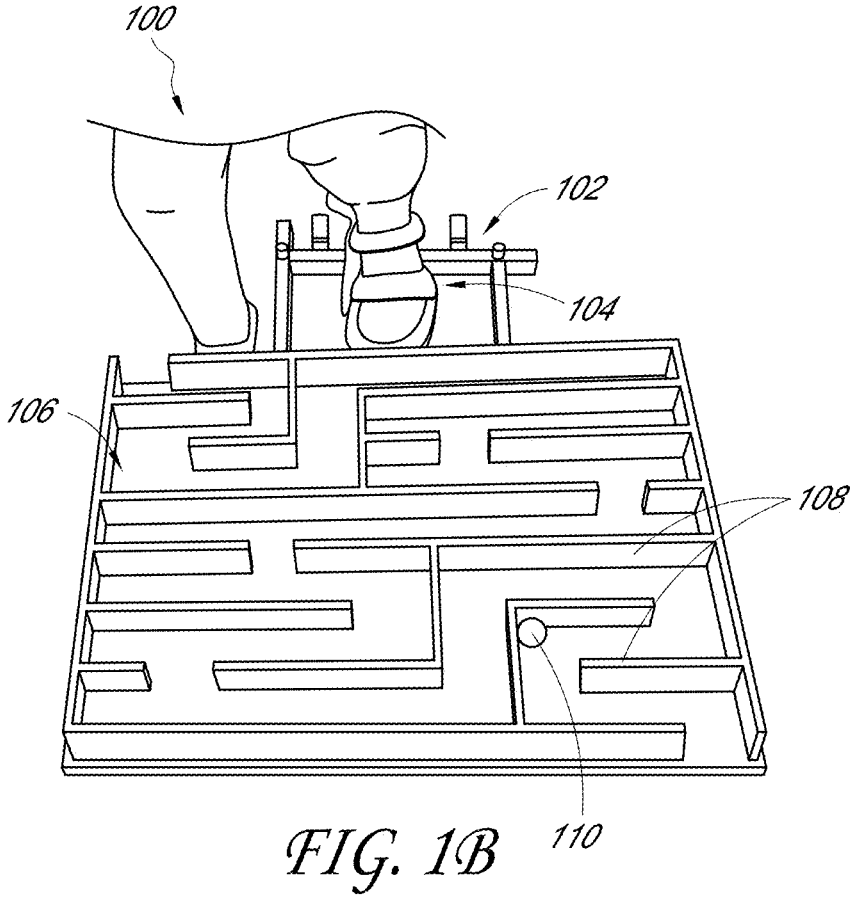
FIG. 1B illustrates a top perspective view of the ankle exerciser device during use by the user, showing an example maze board thereof.

FIGS. 1A and 1B illustrate side and top perspective views, respectively, of an embodiment of an ankle exerciser device 100 during use by a user. As will become more apparent from the following description, the ankle exerciser device 100 (also referred to hereafter as the device 100) is configured to aid a user in strengthening his or her ankle, thereby improving mobility, through the use of a fun and engaging game. Users in need of rehabilitation or mobility exercises often find such exercises to be boring and tedious. Use of the device 100, however, allows the user to perform ankle exercises in a fun and engaging way. This has been shown to greatly increase the likelihood that the user will perform the necessary exercises, leading to improved patient outcomes.

With reference to FIGS. 1A and 1B, the ankle exerciser device 100 generally comprises a base component 102, a jointed foot plate assembly 104, and a maze board 106. The base component 102 is shown in more detail in FIG. 2A, which is described further below. The jointed foot plate assembly 104 is shown in more detail in FIG. 2B, which is described further below. In general, the base component 102 is configured to rest on a support surface, such as the floor or the ground, and is configured to support the jointed foot plate assembly 104 and the maze board 106. The jointed foot plate assembly 104 is attached or otherwise connectable to the base component 102 through a joint 124 (see FIG. 2B) which allows the jointed foot plate assembly 104 to tilt, pivot, and/or rotate, or otherwise move relative to the base component 102. As shown in FIGS. 1A and 1B, during use, a user positions his or her foot on the jointed foot plate assembly 104. The jointed foot plate assembly 104 is also rigidly attached or otherwise rigidly connectable to the maze board 106. For example, as shown in FIGS. 1A and 1B, the maze board 106 extends out in front of the jointed foot plate assembly 104.

As best shown in the top perspective view of FIG. 1B, the maze board 106 can include a plurality of maze walls 108. The maze walls 108 can be arranged on the maze board 106 so as to form a maze, for example, having a starting point, an ending point, a path connecting the starting point to the ending point, and one or more dead end or decoy paths. In some embodiments, the maze board 106 is configured such that the maze walls 108 can be rearranged to form mazes having other paths. For example, in some embodiments, the maze walls 108 include pegs that slot into holes formed in the maze board 106 such that the maze walls 108 can be moved to different locations on the maze board 106 by slotting the pegs into a different set of holes on a different position on the maze board 106.

FIG. 1B also illustrates that a ball 110 can be placed within the maze of the maze board 106. Because the maze board 106 is rigidly attached to the jointed foot plate assembly 104 (which as noted above is configured to pivot, tilt, and/or rotate relative to the base component 102), the maze board 106 can be moved through a range of motions by applying various forces and torques to the jointed foot plate assembly 104 with the user's foot. Thus, by moving the ankle (and thereby applying forces and torques to the jointed foot plate assembly 104) the user is able to tilt the maze board 106 in all directions (e.g., forwards, backwards, and side to side). The user's goal can be to move the ball 110 through the maze of the maze board 106. Completing the goal can require the user to move his or her ankle in various directions so as to tilt the maze board 106 accordingly. Such motions can be configured to strengthen the user's ankle and increase the mobility thereof.

In some embodiments, the maze of the maze board 106 can be configured to maximize the range of motions that must be supplied by the user's ankle and foot. For example, the maze can include long side to side paths that cause the user to flex his or her ankle first all the way in one direction and then all the way in the opposite direction. If the user's ankle mobility is limited, the maze can initially be configured such that only small motions of the ankle are necessary to complete the maze. As the user uses the device 100 and his or her ankle is strengthened, the maze can be reconfigured to require more aggressive motions, further strengthening the ankle.

Because the device 100 utilizes a maze the ankle exercises are perceived as fun and engaging by the user. This increases the likelihood that the user will use the device 100 and improves patient outcomes by strengthening the ankle.

Figure 2A:
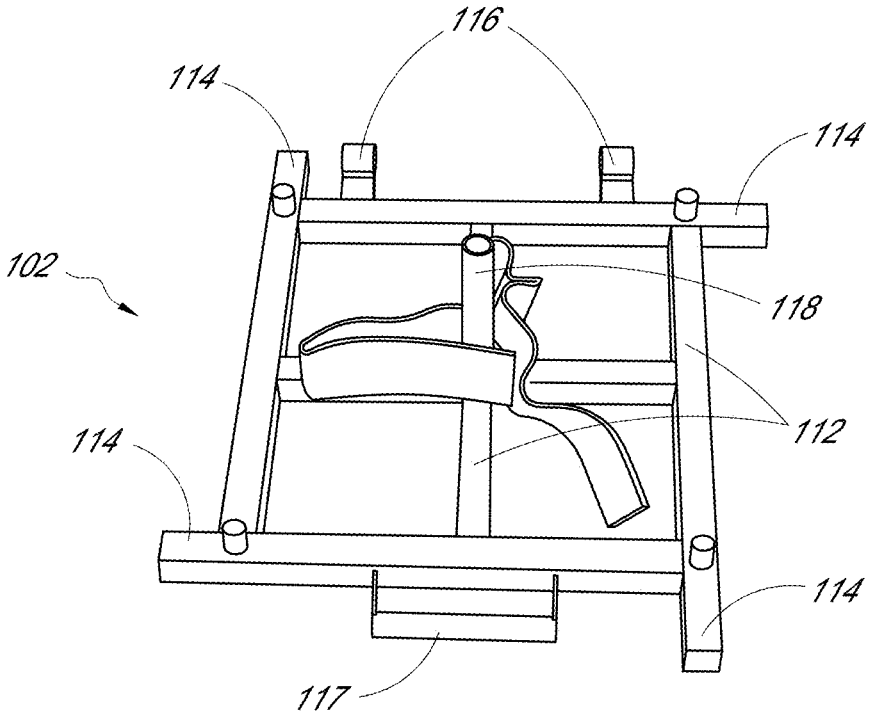
FIG. 2A is a top perspective view of an embodiment of a base component for the ankle exerciser device of FIGS. 1A and 1B.

FIG. 2A is a top perspective view of an embodiment of the base component 102 for the ankle exerciser device 100. As noted above, the base component 102 generally supports and provides stability for the device 100 during use. Accordingly, although a particular embodiment is illustrated in the figures and described below, other embodiments are also possible. In the illustrated embodiment, the base component 102 comprises a support frame 112, extendible legs 114, wheels 116, a handle 117, and a post 118. The frame 112 can be configured to rest on a support surface, such as the ground or floor. The frame 112 can be sufficiently wide so as to provide stability and prevent or reduce the likelihood that the device 100 will tip during use. To aid in stability, in some embodiments, the base component 101 can include extendible legs 114 that can extend outwardly from the frame 112 to provide additional stability against tipping. In the illustrated embodiment, wheels 116 and a handle 117 are included to facilitate the portability of the device 100.

In the illustrated embodiment, the base component 102 includes a post 118 that extends upwardly therefrom. For example, the post 118 can comprise a cylindrical rod that extends upwardly from the frame 112. As will be described in more detail below, the post 118 is configured to be inserted into a sleeve 122 on the jointed foot plate assembly 104 to connect the jointed foot plate assembly 104 to the base component 102. Other systems and mechanisms for connecting the jointed foot plate assembly 104 to the base component 102 are also possible.

Figure 2B:
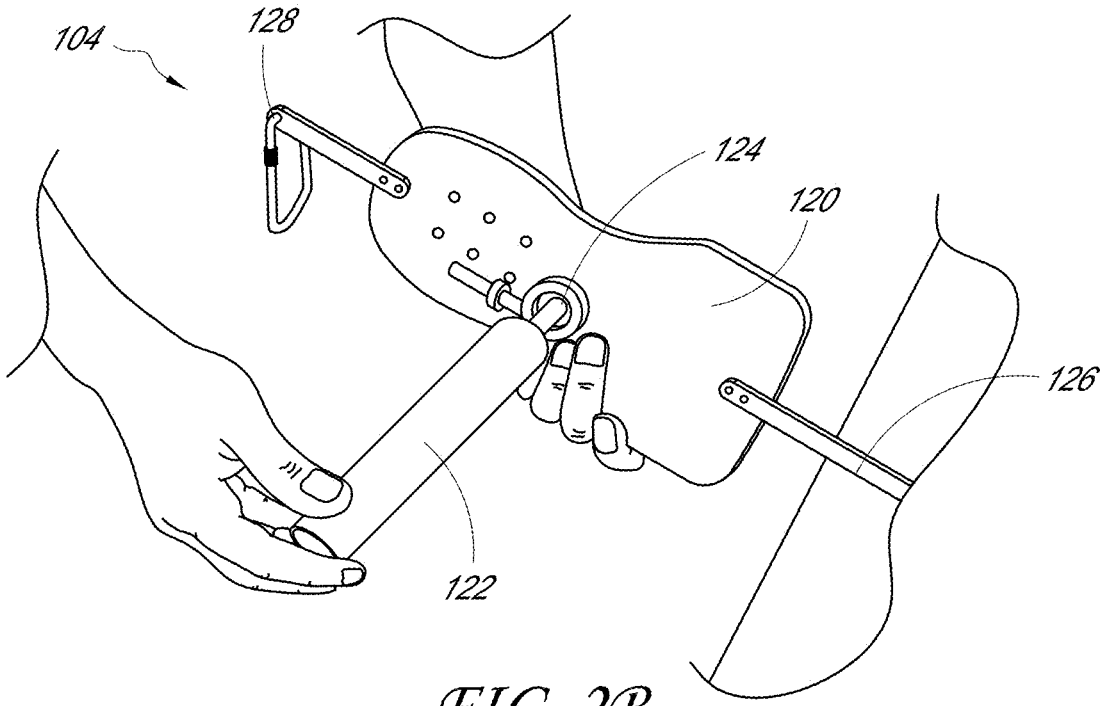
FIG. 2B is a bottom perspective view of an embodiment of a jointed foot plate assembly for the ankle exerciser device of FIGS. 1A and 1B.

FIG. 2B is a bottom perspective view of an embodiment of the jointed foot plate assembly 104 for the ankle exerciser device 100. Although a particular embodiment is illustrated in the figures and described below, other embodiments are also possible. In the illustrated embodiment, the jointed foot plate assembly 104 comprises a foot plate 120, the sleeve 122, a joint 124, a maze board connector 126, and an attachment point 128. Not all of these components need be included in all embodiments.

The foot plate 120 is configured to provide a platform for receiving the user's foot. In some embodiments, the foot plate 120 comprises the shape of a foot. Below the foot plate 120, the jointed foot plate assembly 104 includes the sleeve 122. The sleeve 122 can comprise a hollow cylindrical tube configured to fit over the post 118 of the base component 102. The sleeve 122 is connected to the foot plate 120 by the joint 124. The joint 124 can be configured to allow the foot plate 120 to pivot, tilt, and/or rotate relative to the sleeve 122, and, since the sleeve 122 can be connected to the base component 102, the joint 124 can allow the foot plate 120 to pivot, tilt, and/or rotate relative to the base component 102. In the illustrated embodiment, the joint 124 comprises a ball and socket joint, with the ball mounted to the end of the sleeve 122 and the socket mounted to the underside of the foot plate 120.

Figure 2C:
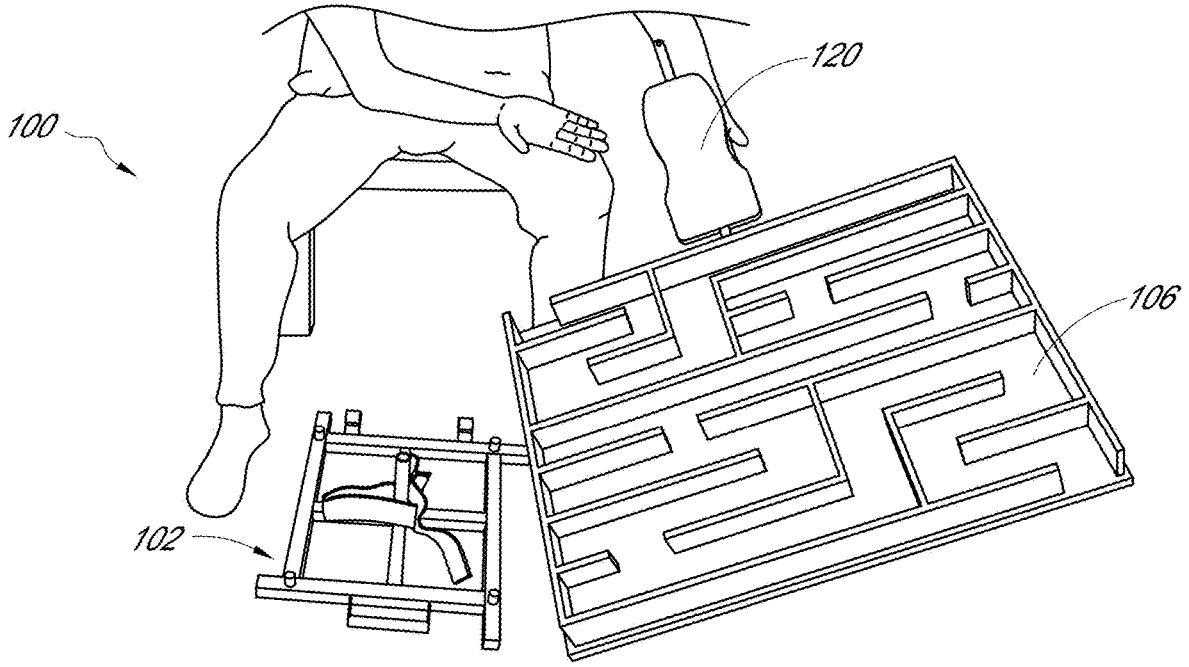
FIG. 2C is a top perspective view of the foot plate assembly of FIG. 2B attached to an embodiment of a maze board for the ankle exerciser device of FIGS. 1A and 1B.

As illustrated in FIG. 2B, a maze board connector 126 extends from the front (e.g., the toe end) of the foot plate 120. As can be seen in FIGS. 2B and 2C, the maze board connector 126 can rigidly connect the foot plate 120 to the maze board 106. Additional attachment points 128 can also extend from the foot plate 120. For example, in the illustrated embodiment, an additional attachment point 128 extends from the rear (e.g., the heel) of the foot plate 120. The attachment points 128 can be used for attachment of weights and/or bands, for example, as will be described below with reference to FIGS. 4A-5B.

Figure 2D:
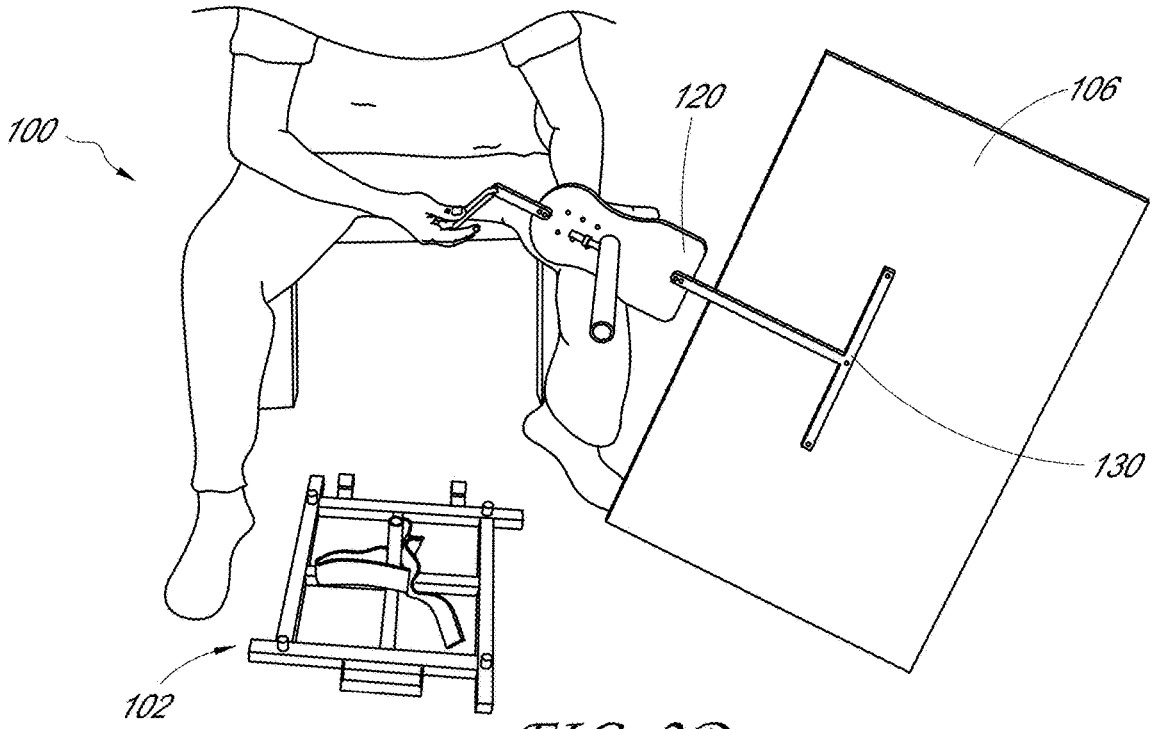
FIG. 2D is a bottom perspective view of the foot plate assembly of FIG. 2B attached to an embodiment of a maze board for the ankle exerciser device of FIGS. 1A and 1B.

FIGS. 2C and 2D are top and bottom perspective views, respectively, of the foot plate assembly 104 attached the maze board 106 for the ankle exerciser device 100. FIG. 2D illustrates that maze board 106 can include maze board supports 130 positioned on the underside of the maze board 106. The maze board supports 130 can connect to the maze board connector 126 that extends from the foot plate 120. In some embodiments, the connection between the foot plate 120 and the maze board 106 is configured such that the maze board 106 can selectively attach to the foot plate 120. This can allow the maze board 106 to be removed from the foot plate 120, for example, for storage.

Figure 2E:
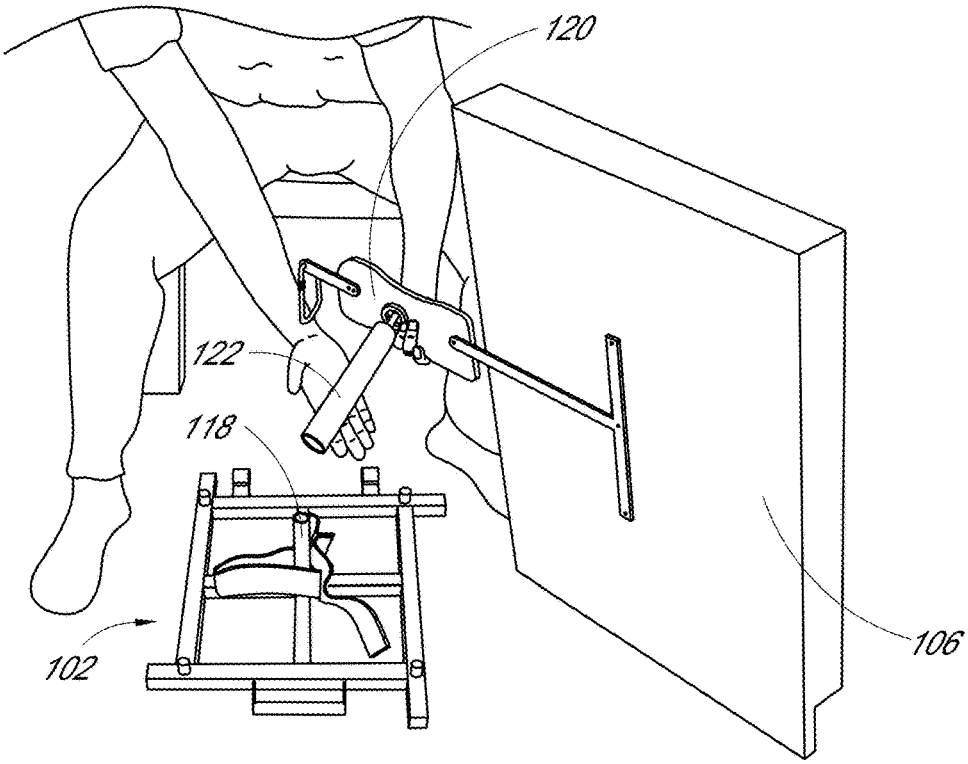
FIG. 2E illustrates an example assembly step wherein the jointed foot plate assembly and maze board are attached to the base component, according to an embodiment.

FIG. 2E illustrates an example assembly step wherein the jointed foot plate assembly 104 and maze board 160 are attached to the base component 102, according to an embodiment. As illustrated, the sleeve 122 of the jointed foot plate assembly 104 can be installed over the post 118.

Figure 2F:
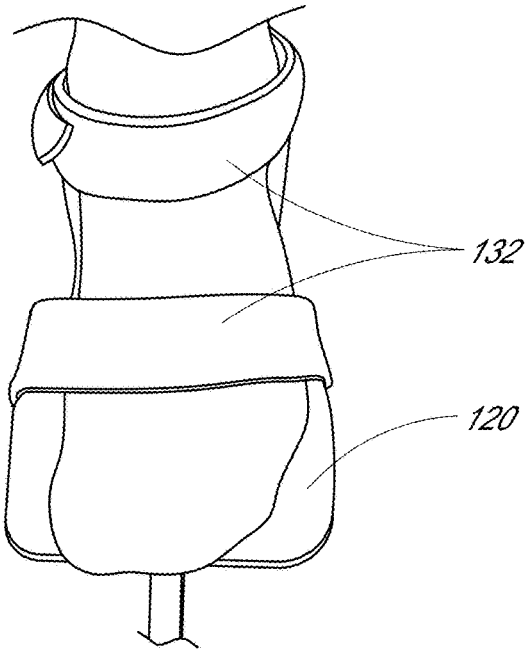
FIG. 2F illustrates a top perspective view of the jointed foot plate component with a foot of a user strapped thereto.

FIG. 2F illustrates a top perspective view of the jointed foot plate assembly 104 with a foot of a user strapped thereto. As shown, straps 132 can be included to secure the foot to the foot plate 120.

Figure 3A:
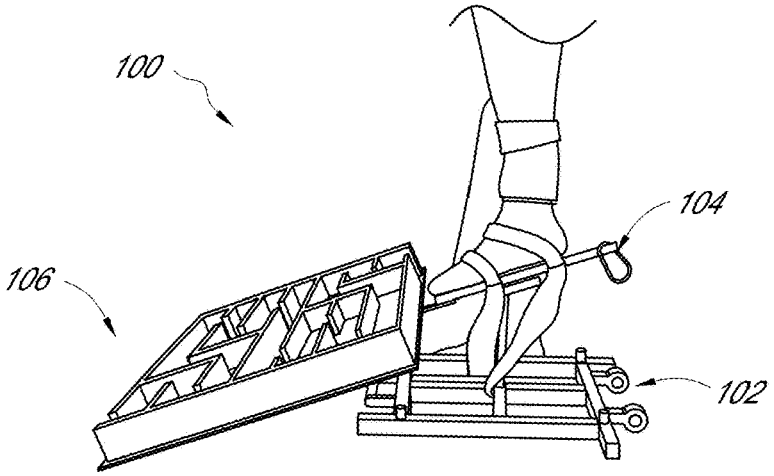
FIGS. 3A-3C illustrate the ankle exerciser device during use by a user and further show an example range of motion for the device.
Figure 3B:
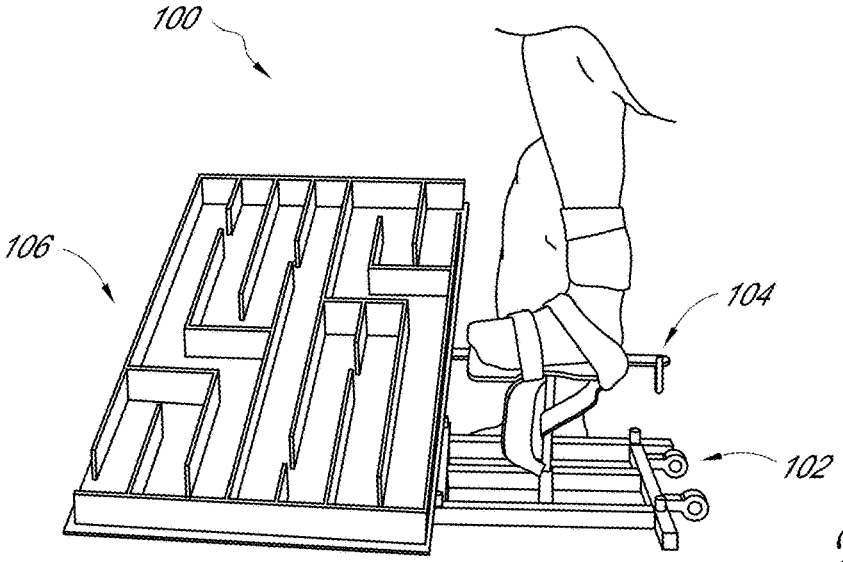
Figure 3C:
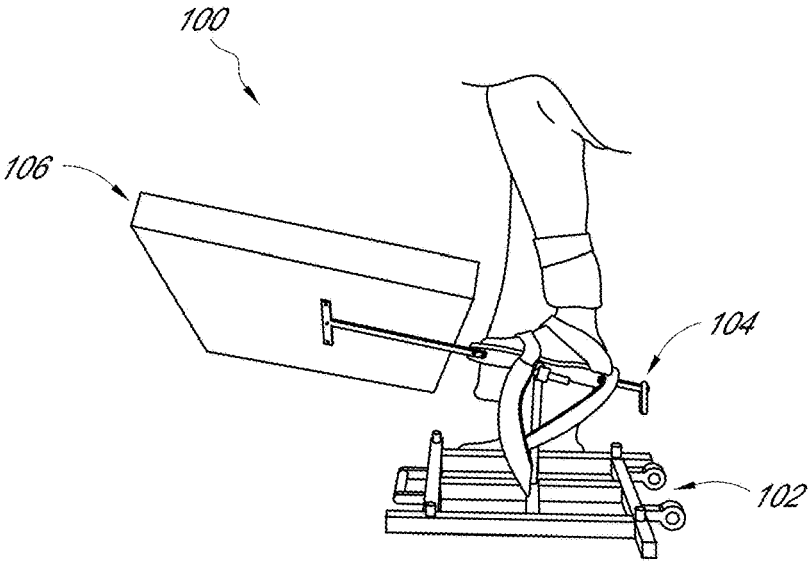

FIGS. 3A-3C illustrate the ankle exerciser device 100 during use by a user and further show an example range of motion for the device 100. As shown, the user can move his or her foot and ankle to cause the maze board 106 to tilt in various directions to move the ball through the maze.

Figure 4A:
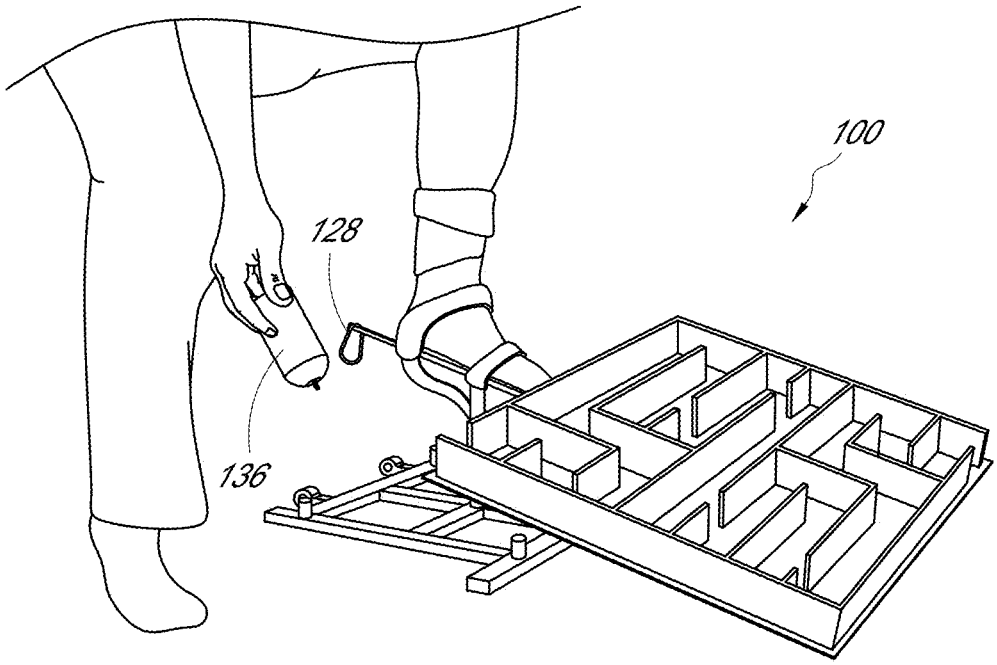
FIGS. 4A and 4B illustrate that weights can be attached to the jointed foot plate assembly of the ankle exerciser device to assist a user during use.
Figure 4B:
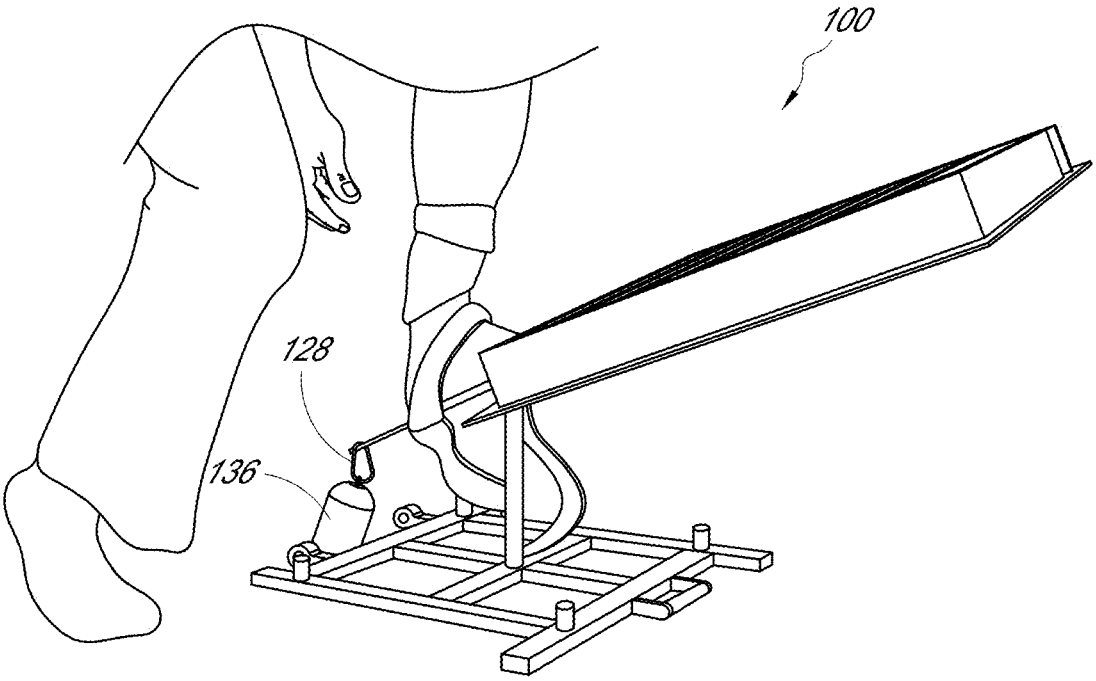

FIGS. 4A and 4B illustrate that weights 136 can be attached to the jointed foot plate assembly 104 of the ankle exerciser device 100 to assist a user during use. For example, the weights 136 can be clipped to the attachment point 128 on the foot plate 120. In the illustrated embodiments, the weights 136 comprise sandbags, although other types of weights 106 can also be used. By adjusting the weights 136, the forces required to move the maze board 106 can be varied. For example, by positioning weights 136 on the rear of the foot plate 120, the weights 136 can counterbalance the weight of the maze plate 106, making it easier to move. Conversely, weights 136 can be added in other places, for example, in front of the foot plate 120 to make it harder to move the maze plate 106. In this way, the resistance can be varied, and the device can be adjusted to accommodate users with different levels of ankle mobility.

Figure 5A:
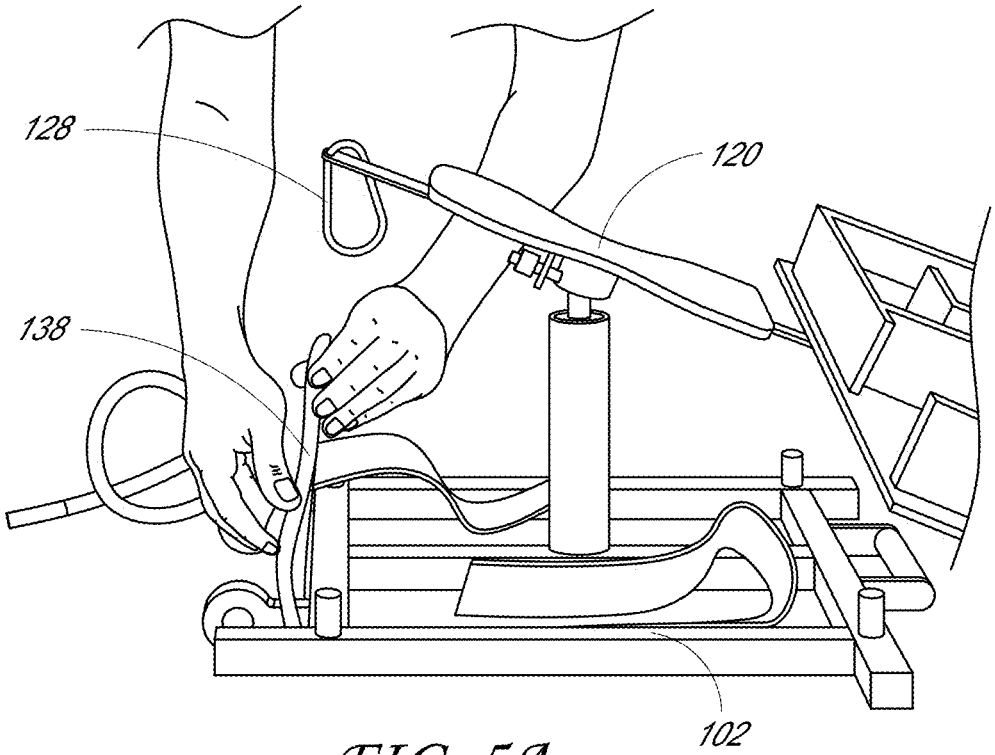
FIGS. 5A and 5B illustrate that bands can be attached to the jointed foot plate assembly of the ankle exerciser device to assist a user during use.
Figure 5B:
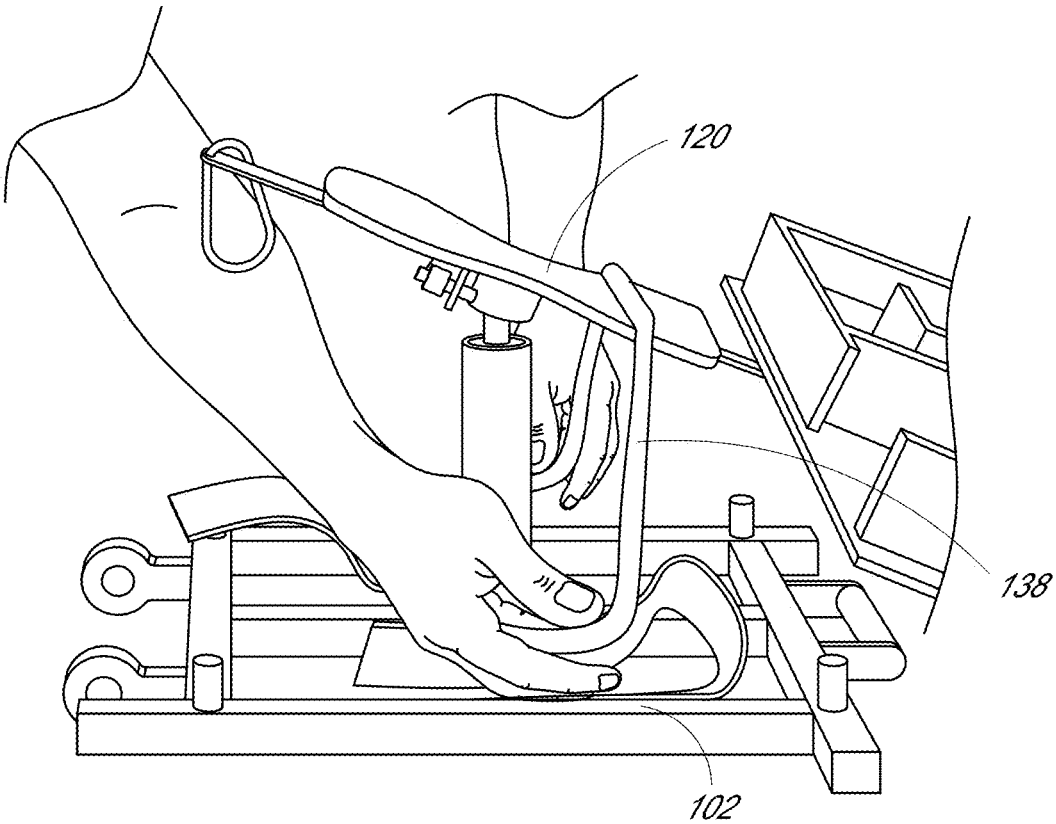

FIGS. 5A and 5B illustrate that bands 138 can be attached to the jointed foot plate assembly of the ankle exerciser device to assist a user during use. The bands can be used in a manner similar to the weights 136. FIG. 5A illustrates that a band 138 can be positioned between the base component and the rear attachment point 128 to counterbalance the weight of the maze board 106. FIG. 5B illustrates that a band 138 can be positioned between the front of the foot plate 120 and the base component 102 to increase the weight of the maze board 106.

Various modifications to the implementations described in this disclosure may be readily apparent to those skilled in the art, and the generic principles defined herein may be applied to other implementations without departing from the spirit or scope of this disclosure. Thus, the claims are not intended to be limited to the implementations shown herein, but are to be accorded the widest scope consistent with this disclosure, the principles and the novel features disclosed herein. Additionally, a person having ordinary skill in the art will readily appreciate that direction terms, such as "upper" and "lower," are sometimes used for ease of describing the figures, and indicate relative positions corresponding to the orientation of the figure on a properly oriented page and may not reflect the proper orientation of the device as implemented.

Certain features that are described in this specification in the context of separate implementations also can be implemented in combination in a single implementation. Conversely, various features that are described in the context of a single implementation also can be implemented in multiple implementations separately or in any suitable sub combination. Moreover, although features may be described above as acting in certain combinations and even initially claimed as such, one or more features from a claimed combination can in some cases be excised from the combination, and the claimed combination may be directed to a sub combination or variation of a sub combination.

In describing the present technology, the following terminology may have been used: The singular forms "a," "an," and "the" include plural referents unless the context clearly dictates otherwise. Thus, for example, reference to an item includes reference to one or more items. The term "ones" refers to one, two, or more, and generally applies to the selection of some or all of a quantity. The term "plurality" refers to two or more of an item. The term "about" means quantities, dimensions, sizes, formulations, parameters, shapes, and other characteristics need not be exact, but may be approximated and/or larger or smaller, as desired, reflecting acceptable tolerances, conversion factors, rounding off, measurement error and the like and other factors known to those of skill in the art. The term "substantially" means that the recited characteristic, parameter, or value need not be achieved exactly, but that deviations or variations, including for example, tolerances, measurement error, measurement accuracy limitations and other factors known to those of skill in the art, may occur in amounts that do not preclude the effect the characteristic was intended to provide.

Numerical data may be expressed or presented herein in a range format. It is to be understood that such a range format is used merely for convenience and brevity and thus should be interpreted flexibly to include not only the numerical values explicitly recited as the limits of the range, but also interpreted to include all of the individual numerical values or sub-ranges encompassed within that range as if each numerical value and sub-range is explicitly recited. As an illustration, a numerical range of "about 1 to 5" should be interpreted to include not only the explicitly recited values of about 1 to about 5, but also include individual values and sub-ranges within the indicated range. Thus, included in this numerical range are individual values such as 2, 3 and 4 and sub-ranges such as 1-3, 2-4 and 3-5, etc. This same principle applies to ranges reciting only one numerical value (e.g., "greater than about 1") and should apply regardless of the breadth of the range or the characteristics being described. A plurality of items may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

Furthermore, where the terms "and" and "or" are used in conjunction with a list of items, they are to be interpreted broadly, in that any one or more of the listed items may be used alone or in combination with other listed items. The term "alternatively" refers to selection of one of two or more alternatives, and is not intended to limit the selection to only those listed alternatives or to only one of the listed alternatives at a time, unless the context clearly indicates otherwise.

Elements that are described as "connected," "engaged," "attached," or similarly described, shall include being directly and/or indirectly connected, engaged, attached, etc.

Conditional language, such as, among others, "can," "could," "might," or "may," unless specifically stated otherwise, or otherwise understood within the context as used, is generally intended to convey that certain embodiments include, while other embodiments do not include, certain features, elements and/or steps. Thus, such conditional language is not generally intended to imply that features, elements and/or steps are in any way required for one or more embodiments or that one or more embodiments necessarily include logic for deciding, with or without user input or prompting, whether these features, elements and/or steps are included or are to be performed in any particular embodiment. Conjunctions, such as "and," "or" are used interchangeably and are intended to encompass any one element, combination, or entirety of elements to which the conjunction refers.

It should be noted that various changes and modifications to the presently preferred embodiments described herein will be apparent to those skilled in the art. Such changes and modifications may be made without departing from the spirit and scope of the invention and without diminishing its attendant advantages. For instance, various components may be repositioned as desired. It is therefore intended that such changes and modifications be included within the scope of the invention. Moreover, not all of the features, aspects and advantages are necessarily required to practice the present invention. Accordingly, the scope of the present invention is intended to be defined only by the claims that follow.

What is claimed is:

1. An ankle exerciser device, comprising:

a base component;

a jointed foot plate assembly attached to the base component, the jointed foot plate assembly comprising a foot plate and a joint, the joint configured to allow the foot plate to tilt, pivot, and/or rotate relative to the base component; and a maze board attached to the foot plate of the jointed foot plate assembly, the maze board comprising a maze.

2. The device of claim 1, wherein the base comprises a post, and the jointed foot plate assembly comprises a sleeve, and wherein the post is received within the sleeve to connect the jointed foot plate assembly to the base component.

3. The device of claim 2, wherein the joint comprises a ball and socket joint.

4. The device of claim 3, wherein a ball of the ball and socket joint is attached to an end of the sleeve and a socket of the ball and socket joint is attached an underside of the foot plate.

5. The device of claim 1, further comprising a ball positioned within the maze of the maze board.

6. The device of claim 5, wherein a user is capable of moving the ball through the maze by tiling the maze board via the foot plate.

7. A method for exercising the ankle, the method comprising:

providing the device of claim 1;

positioning a ball in the maze of the maze board; and moving the ball through the maze by applying forces to the foot plate with a foot.

* * * * *